US007004285B2

(12) United States Patent
Bailey

(10) Patent No.: US 7,004,285 B2
(45) Date of Patent: Feb. 28, 2006

(54) LOAD-SENSING MECHANISM FOR AERIAL WORK APPARATUS

(76) Inventor: Jeffrey H. Bailey, 3215 Heartland La., Racine, WI (US) 53402

( * ) Notice: Subject to any disclaimer, the term of this patent is extended or adjusted under 35 U.S.C. 154(b) by 0 days.

(21) Appl. No.: 10/603,967

(22) Filed: Jun. 25, 2003

(65) Prior Publication Data

US 2004/0262078 A1 Dec. 30, 2004

(51) Int. Cl.
*B66F 11/04* (2006.01)

(52) U.S. Cl. ..... 182/19; 182/2.1

(58) Field of Classification Search ..... 182/2.1–2.11, 182/63.1, 69.4–69.6, 18, 19
See application file for complete search history.

(56) References Cited

U.S. PATENT DOCUMENTS 4,003,482 A 1/1977 Cheze
4,345,539 A * 8/1982 Williams ..... 116/68
4,456,093 A 6/1984 Finley et al.
6,405,114 B1 6/2002 Priestley et al.
6,439,341 B1 8/2002 Engvall et al.
6,585,079 B1 * 7/2003 Weyer ..... 182/2.7

* cited by examiner

*Primary Examiner*—Alvin Chin-Shue
(74) *Attorney, Agent, or Firm*—Jansson, Shupe, Munger & Antaramian

(57) ABSTRACT

An aerial work apparatus having a boom mounted to a base, a platform attached to the distal end of the boom, a boom mechanism for positioning the platform, a boom control module mounted with respect to the platform, a vertical load-sensing mechanism mounted at the platform for measuring the platform load and generating a load signal based on that measurement and a controller operationally attached to the boom mechanism and boom control module. The controller receives the load signal and at least one position signal relating to the position of the platform and generates at least one control signal based thereon. The boom mechanism is controlled by the boom control module through the controller. Preferably, the load-sensing mechanism is held in position by a vertical holding column attached at the distal end of the boom so that the mechanism fully supports a platform support member attached to the platform.

16 Claims, 6 Drawing Sheets

LOAD-SENSING MECHANISM FOR AERIAL WORK APPARATUS

FIELD OF THE INVENTION

This invention is related generally to aerial work apparatus and, more particularly, to aerial work apparatus having load-sensing mechanisms to measure the load on a platform attached to the distal end of a boom.

BACKGROUND OF THE INVENTION

Various types of aerial work apparatus are well known as excellent tools for lifting workers or material upon a platform to elevated and oftentimes obstructed locations. Such equipment is provided with an extendable boom that can be rotated about its counter-weighted base as well as elevated to varying angles off the ground. The platform is commonly provided with a work basket to hold workers and material but it may instead consist of a material-handling mechanism such as a winch or fork-lifting tines.

Each model of this line of apparatus typically has a rated capacity for the load it may carry at the distal end of the boom. This rated capacity is based on safety standards to arrive at a prescribed limit for the load to be carried whenever the boom is substantially extended and level to the ground. Exceeding this rated capacity technically risks overcapacity since any greater load is presumed capable of causing the apparatus to overturn. Determined efforts are made therefore to avoid overcapacity given the obvious potential for serious injury to workers on the apparatus as well as in its immediate vicinity should the equipment tip over.

A single capacity for the platform has long been a convenient safety parameter since keeping the lifted load under this figure was a simple way of avoiding the possibility of overcapacity regardless of boom position or boom length The drawback with this approach is that platform capacity varies not only with the load at the end of the boom but also with the boom's degree of elevation and range of extension. In particular, the size of load that can be safely lifted can exceed the rated capacity by simply not fully extending the boom. As a consequence, full advantage of such equipment is never achieved because the usefulness of the machine has been intentionally diminished.

One solution to this problem has been to provide the aerial work apparatus with charts that allow the operator to manually determine the maximum platform capacity for a certain combination of boom angle and length. These charts would diagram zones within which the prescribed platform capacity was applicable. Even though these charts would often be permanently affixed to the apparatus at a location easily seen by the operator, the charts were subject to damage or defacing. They were also overlooked or ignored by careless operators. More importantly, many operators were often completely unaware of the actual size of the load being lifted on the platform to enable them to even begin to use the charts.

Measuring or sensing the load on the platform of an aerial work apparatus in an automatic fashion would serve as a welcome alternative to placing sole reliance upon the operator to measure and monitor platform capacity. Although attempts to accomplish this have been made in the past, these approaches have been excessively complex and not particularly accurate.

An example of such an approach is disclosed in U.S. Pat. No. 4,456,093 (Finley et al.). Here a determination of the load on a work platform mounted on a boom was done by computer by solving simultaneous equations from data produced by pressure transducers attached to the slave hydraulic cylinder and by load cells inside the boom. In other words, the platform load was measured indirectly by reading the force required to keep the platform level and the force carried by the boom. Variables upon which these calculations depended included the elevational angle of the boom, the length the boom was at, and the position of the load on the platform.

Such a system as the one in Finley et al. achieves no more than an indirect approximation of the load weight. This approximation, based on a mathematical formula and requiring multiple sensors for the data needed in that formula, results in limited accuracy at great expense. Moreover, exceptions need to be made by such systems between the monitoring of a static load with that of a live load, i.e. where people or objects are moving or being moved on the platform. Adjustments also need to be made where there is an overhung load, i.e. a portion of the load is overhanging the work basket or material-handling mechanism.

This invention addresses such problems and shortcomings with a mechanism that measures the load directly at the platform in a simple and inexpensive manner.

OBJECTS OF THE INVENTION

It is a primary object of this invention to provide a load-sensing mechanism for use on an aerial work apparatus that overcomes some of the problems and shortcomings of the prior art, including those mentioned above.

Another object of this invention is to provide a load-sensing mechanism for use on an aerial work apparatus having a boom and a platform that measures the load weight of the platform directly at the platform.

Another object of this invention is to provide a novel load-sensing mechanism for use on an aerial work apparatus that directly measures the load on the platform of the apparatus in a highly accurate fashion regardless of the position or configuration of the boom supporting that platform.

Another object of this invention is to provide an improved load-sensing mechanism for use on an aerial work apparatus that accurately measures the load on the platform of the apparatus regardless of the exact location of that load upon the platform, whether all or some of that load overhangs the platform, or whether that load is not at rest with respect to the platform.

Another object of this invention is to provide an exceptional load-sensing mechanism for use on an aerial work apparatus that directly measures the load on the platform of the apparatus in a highly accurate fashion and provides an immediate display of that measurement irrespective of movement of the platform.

Another object of this invention is to provide a vertical load-sensing mechanism for use on an aerial work apparatus that accurately measures the load on the platform of the apparatus so as to generate a load signal that is processed by a controller whereby any overcapacity movement of the boom can be immediately halted.

Another object of the invention is to provide a highly accurate load-sensing mechanism for use on an aerial work apparatus that directly measures the load supported by the platform on the apparatus and yet is simple to manufacture, easy to install and maintain, and highly reliable to operate.

SUMMARY OF THE INVENTION

This invention is an aerial work apparatus having a base, a boom mounted to the base, a work platform attached to the distal end of the boom, a mechanism operationally connected to the boom so as to position the platform, a boom control module mounted on the platform, a vertical load-sensing mechanism mounted at the platform for measuring the platform load and then generating a load signal based on that measurement, and a controller electronically connected to the boom mechanism and the boom control module, whereby the boom control module controls the boom mechanism via the controller. Furthermore, the controller receives and processes the load signal and at least one position signal relating to the position of the platform to generate at least one control signal based on those signals.

The base includes both a vehicle-mounted base such as on the bed of a trailer pulled by a truck as well as a self-propelled mobile base operable from the ground and from the work platform. The vehicle-mounted base remains stationary when the boom is in use.

In one preferred embodiment, any control signals generated by the controller include at least a limit signal arising when the controller makes a determination of overcapacity. When this occurs, the boom control module receives this limit signal and any overcapacity movement by the boom and thereby of the platform is halted. Such overcapacity movement includes both further extending of the boom and lowering of the boom.

In another highly preferred embodiment, the aerial work apparatus also includes an informational display console mounted with respect to the platform. In this embodiment, the control signals generated by the controller also include informational signals based on a determination of platform load and platform capacity. The informational display console then receives and processes these informational signals so as to display the platform load and the platform capacity. The platform capacity will vary with changes in the position of the platform, thereby alerting the operator with respect to his status and the limits to his positioning of the platform so as to avoid overcapacity.

Most desirable is that the informational display console also receives and processes the limit signal so as to display an overcapacity message, whereby the operator is alerted that the boom control module has been overridden. A highly desired embodiment has the informational display console integral with the boom control module.

A certain desired embodiment finds the aerial work apparatus also having a platform support member attached to the platform as well as a vertical holding column attached at the distal end of the boom. The vertical holding column holds the load-sensing mechanism in such a position that the platform support member is fully supported by the load-sensing mechanism. In this manner, the mechanism is able to measure the platform load by the forces placed upon it by the platform support member.

In one most preferred form of this embodiment, the load-sensing mechanism includes a load cell. As used herein, the term "load cell" refers to any device that detects a physical force such as the weight of a load and generates a corresponding electrical signal. In this form, it is desirable that the load-sensing mechanism also include a support bushing so that contact between the load-sensing mechanism and the platform support member is made through the support bushing so as to focus the platform load upon the load cell. Highly desirable is where the load cell is a hydraulic load cell.

In another desired form of this embodiment, the aerial work apparatus is ifirther comprised of at least two sleeve bearings attached to the platform that has a substantially frictionless engagement with the holding column. This insures that the only forces being placed on the vertical holding column by the platform are through the platform support member as it rests upon the load-sensing mechanism. It is most preferred that the sleeve bearings pivotally engage the holding column.

In another aspect of this invention, it is directed to an improvement of an aerial work apparatus of the type having a boom mounted to a base and a platform attached to the distal end of the boom. The improvement is comprised of a load-sensing mechanism at the platform for measuring the platform load, a platform support member attached to the platform, and a vertical holding column attached at the distal end of the boom and holding the load-sensing mechanism in position so that the load-sensing mechanism is substantially the only support for the platform support member and therefore is able to fully measure the platform load.

One most preferred embodiment is where the load-sensing mechanism includes a load cell. In this embodiment, it is more preferred that the load-sensing mechanism include a support bushing. A highly preferred embodiment is where the load cell is a hydraulic load cell.

A most desired embodiment of this aspect of the invention is where the aerial work apparatus further includes at least two sleeve bearings attached to the platform and having an engagement to the holding column that is substantially frictionless. Here it is highly desirable that the apparatus have the sleeve bearings pivotally engaged to the holding column.

DETAILED DESCRIPTION OF PREFERRED EMBODIMENT

Figure 1:
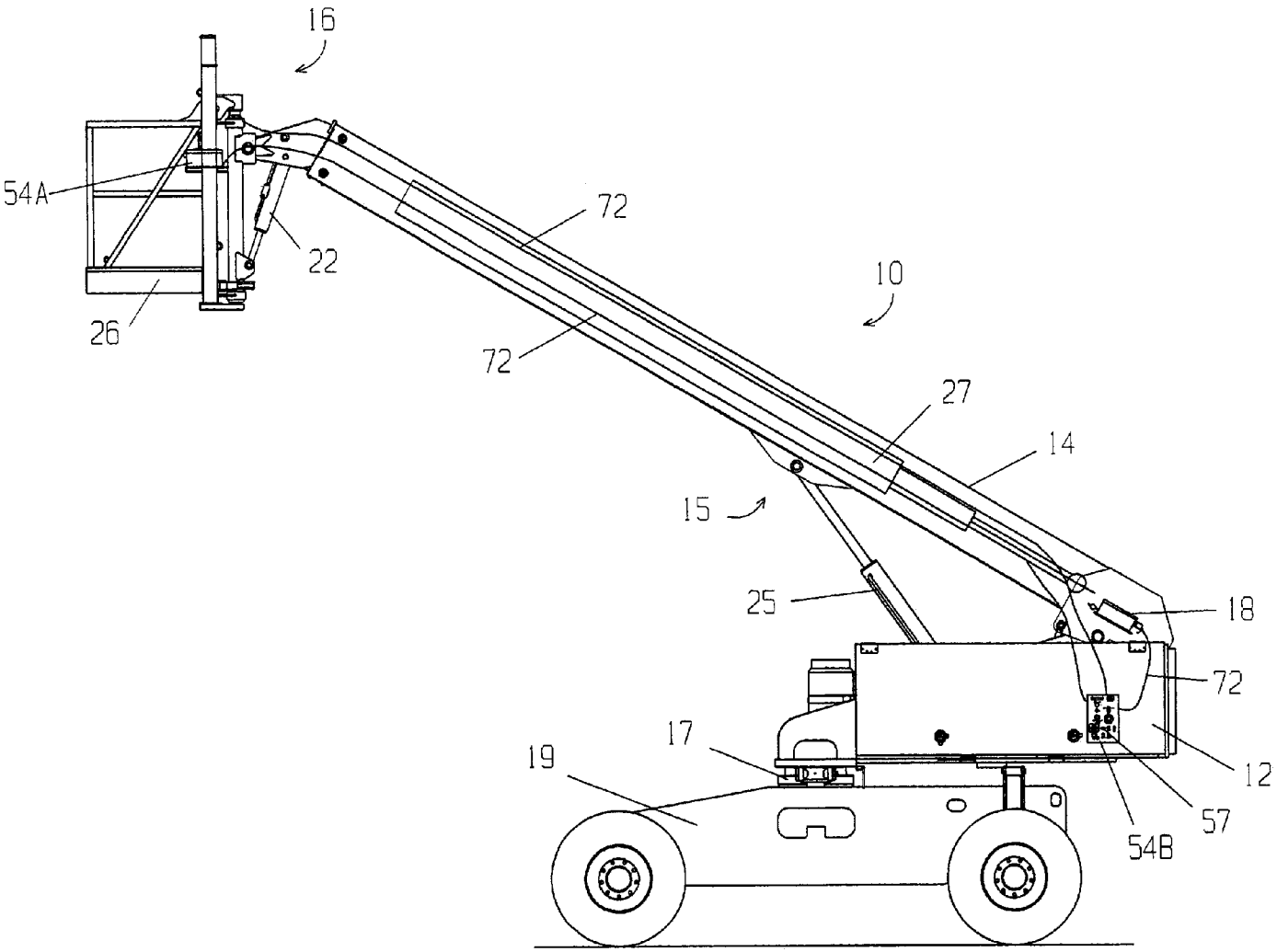
FIG. 1 is a side view of a preferred aerial work apparatus in accordance with this invention with partial cross-section of boom and base.

The drawings illustrate an improved aerial work apparatus 10 in accordance with this invention. As seen in FIG. 1, aerial work apparatus 10 is comprised of a base 12, a boom 14 securely mounted to base 12, and a platform 16 pivotably attached to the outer or distal end of boom 14.

Boom 14 is capable of three-dimensional movement in a fashion known to those skilled in the art. Boom 14 can rotate 360° in either direction in a horizontal plane through the associated rotation of base 12 about base pivot 17. Base pivot 17 is either mounted on the bed of a trailer (not shown) when base 12 is vehicle-mounted or mounted on wheel platform 19 when base 12 is self-propelled as shown in FIG. 1.

Boom 14 can also be selectively raised and lowered to a position measured by the angle formed by boom 14 with a plane parallel to the ground by means of hydraulic boom lift cylinder 25. Furthermore, boom 14 can be telescopically extended or retracted axially by means of hydraulic boom extend cylinder 27. In the aerial work apparatus 10 shown in FIG. 1, boom lift cylinder 25 and boom extend cylinder 27 constitute boom mechanism 15. The degree of elevation and the degree of extension in boom 14 is monitored and measured at any point in time by a length-angle sensor 18 positioned within the boom 14 that generates a position signal 64.

Figure 2:
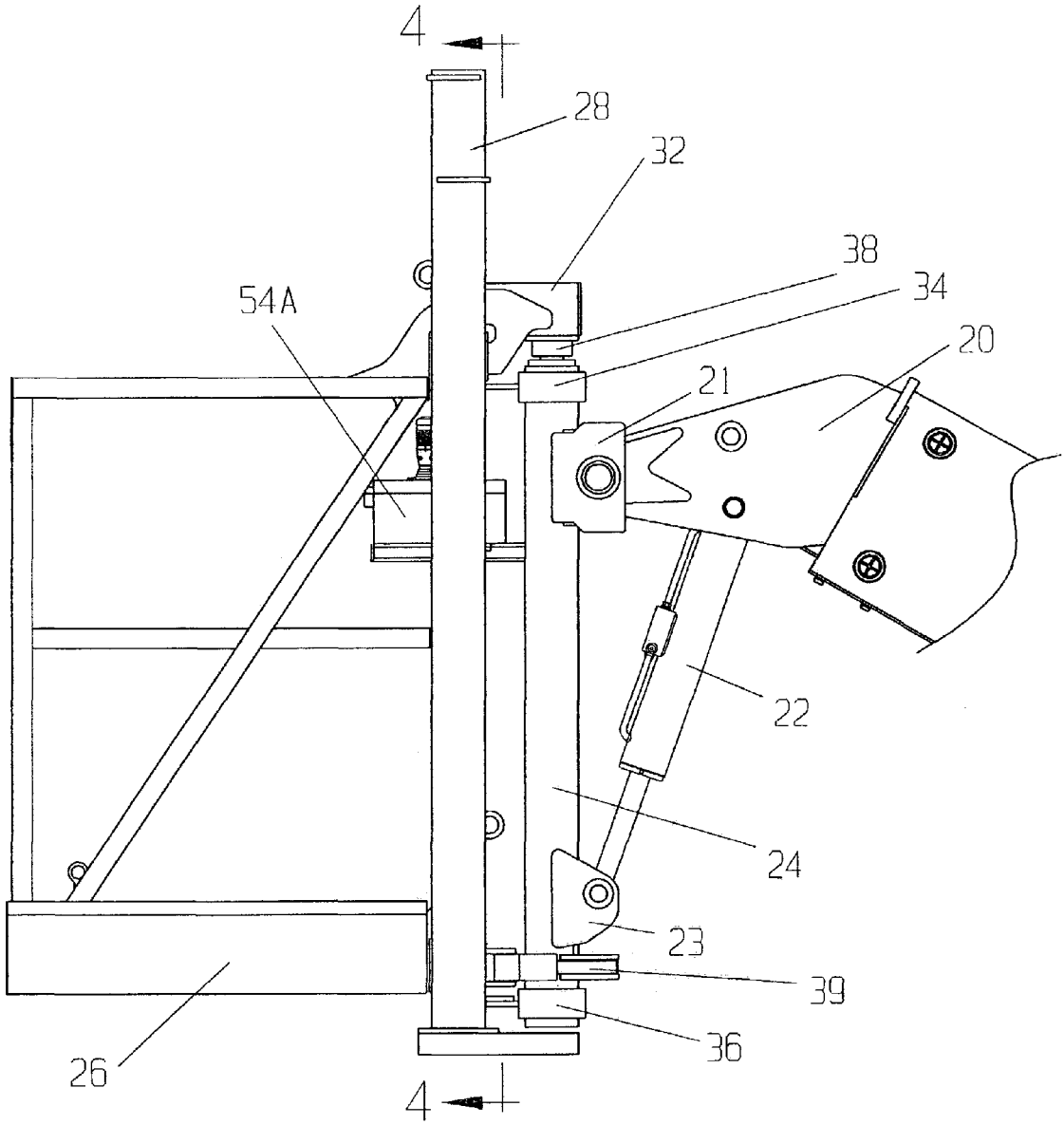
FIG. 2 is an enlarged side view of the aerial work platform of FIG. 1 showing its connection to boom.

As shown in FIG. 2, boom 14 is provided at its distal end with a boom tip 20, a slave-leveling cylinder 22, and a vertical holding column 24. Boom tip 20 is pivotally attached by means of tip bracket 21 to holding column 24 at a point along the upper portion of holding column 24. Slave-leveling cylinder 22 is pivotally attached at one end to holding column 24 at a point along the lower portion of holding column 24 by means of slave-cylinder bracket 23. Slave-leveling cylinder 22 is secured at its other end to boom tip 20. Slave-leveling cylinder 22 functions hydraulically in a manner well known in the art to keep holding column 24 substantially vertical.

Figure 4:
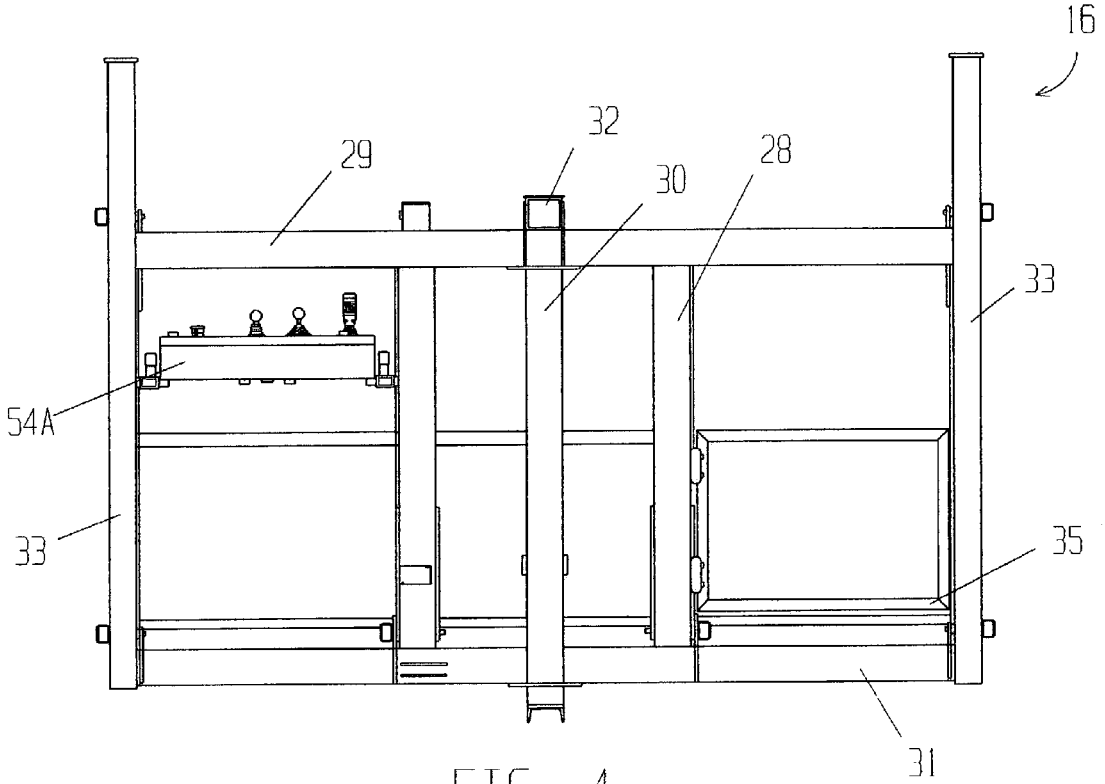
FIG. 4 is a rear sectional view of aerial work platform along section line 4—4 in FIG. 2.

Platform 16 is comprised of a work basket 26 and a rail bracket 28. As illustrated in FIG. 4, a vertical strut 30 is located in the middle of rail bracket 28. Rail bracket 28 further includes a top rail 29, a bottom rail 31, two end columns 33, and a access door 35 to work basket 26.

A platform support member 32 is welded to the top of vertical strut 30. Upper and lower sleeve bearings 34, 36 are rigidly connected to vertical strut 30 at points below platform support member 32. Platform 16 and, in particular, work basket 26 is capable of pivoting in a substantially horizontal plane about holding column 24 by means of hydraulic platform rotational cylinder 39.

Platform 16 is mounted onto boom 14 by resting platform support member 32 upon support bushing 38 at the top of holding column 24. Platform 16 is attached in a substantially frictionless manner to holding column 24 by sleeve bearings 34, 36. Vertical frictional loading at sleeve bearings 34, 36 is preferably kept negligible by use of a sleeve bushing 40 on its interior surface impregnated with polytetrafluoroethylene (commonly known as Teflon®) and by plating holding column 24 with chrome in those areas in contact with sleeve bushings 40.

Upper sleeve bearing 34 attaches to holding column 24 at a point substantially adjacent to the top of holding column 24 and above boom tip 20. Lower sleeve bearing 36 attaches to holding column 24 at a point substantially adjacent to the bottom of holding column 24 and below slave-leveling cylinder 22.

Figure 3:
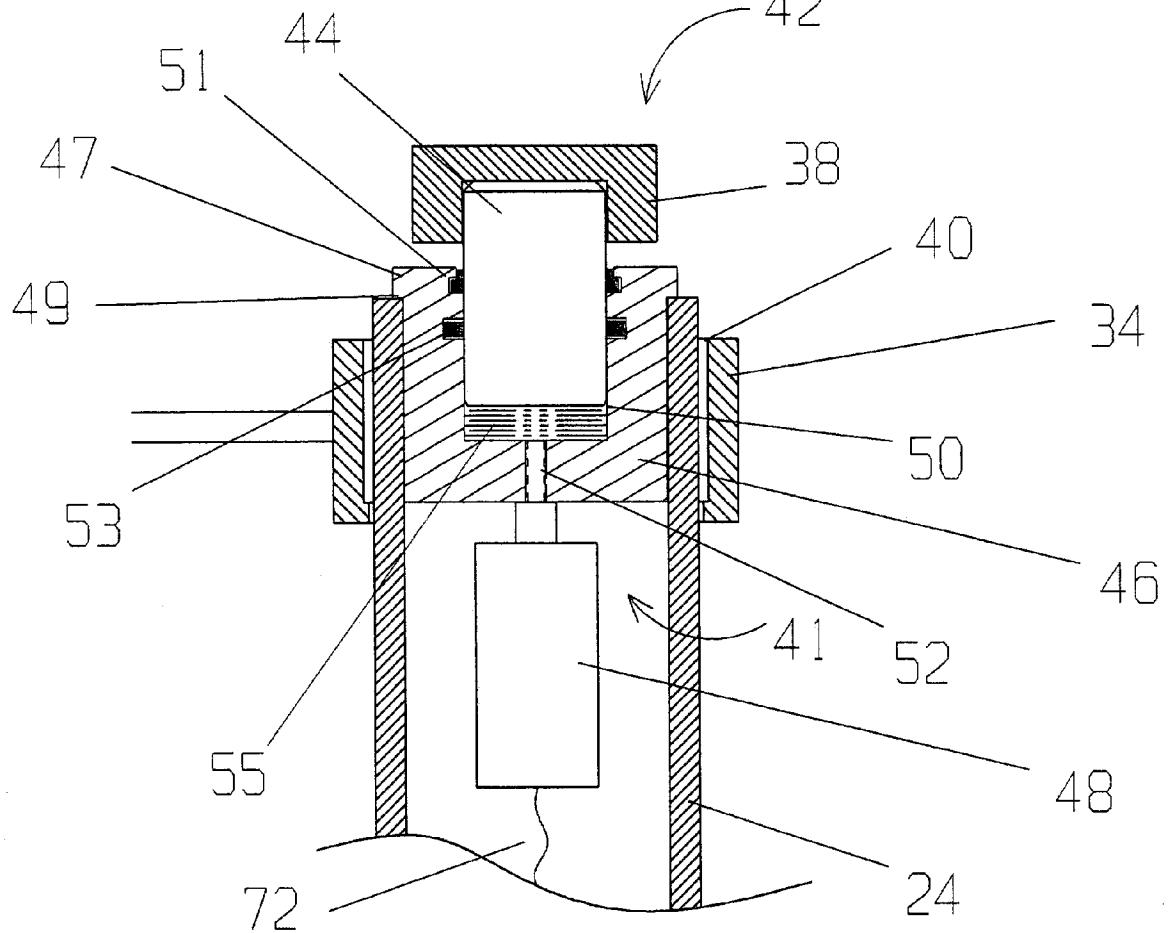
FIG. 3 is an enlarged fragmentary sectional view of load-sensing mechanism and upper sleeve bearing within holding column taken along plane parallel to view in FIG. 2.

As illustrated in FIG. 3, holding column 24 holds load-sensing mechanism 42. Load-sensing mechanism 42 includes support bushing 38 and hydraulic load cell 41. Load cell 4l comprises load piston 44, piston housing 46, and pressure transducer 48. Support bushing 38 is preferably cylindrical and made from nylon. Support bushing 38 has a co-axial aperture on its bottom surface that frictionally receives a top portion of load piston 44. Piston housing 46 is sized to fit within the hollow interior of holding column 24. Housing flange 47 runs circumferentially along the upper edge of piston housing 46. Flange 47 rests upon the upper edge 49 of holding column 24 to further secure piston housing 46 to holding column 24.

Piston housing 46 has a concentric cylindrical housing chamber 50 sized to tolerance to receive load piston 44. Wiper seal 51 is positioned circumferentially along the surface of housing chamber 50 adjacent to its upper opening to seal out debris from entering piston housing 46. Oil seal 53 is positioned circumferentially around the surface of housing chamber 50 below wiper seal 51. Housing port 52 runs through piston housing 46 with an upper end opening into the bottom of housing chanter 50 and with a lower end opening into the interior of holding column 24. Housing port 52 is threaded to allow transducer 48 to be screwed into position beneath piston housing 46.

Oil 55 is contained in the space within housing chamber 50 beneath load piston 44. Oil 55 is placed under compression by the descent of load piston 44 and kept under compression within housing chamber 50 between oil seal 53 around the outer circumference of load piston 44 and transducer 48 within housing port 52.

When load-sensing mechanism 42 is in operation, the pressure of oil 55 is directly proportionate to the force placed upon it by load piston 44. The weight of platform 16 and thereby the weight of any load carried by work basket 26 is applied to load piston 44 in a substantially vertical fashion by means of platform support member 32 being solely supported by load-sensing mechanism 42 at support bushing 38.

Transducer 48 is preferably one having a range of 0–1500 PSI. Transducer 48 generates a load signal 62 proportionate to the pressure of oil 55 within housing chamber 50 and, in particular, within housing port 52. A controller 57 is connected by cable 72 to receive the load signal 62 and a position signal 64 from length-angle sensor 18. Controller 57 is preferably a suitably pre-programed microprocessor.

Figure 5:
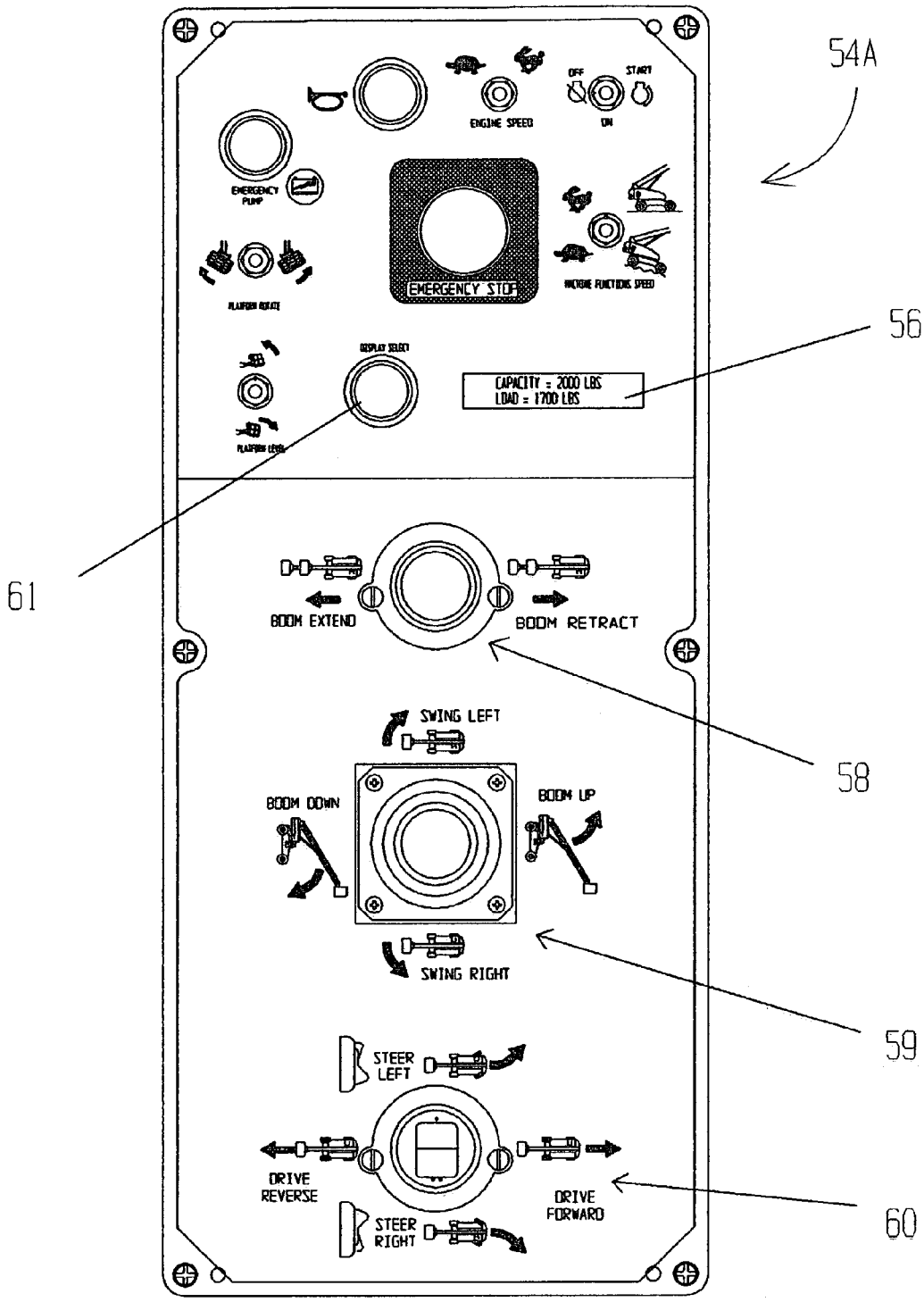
FIG. 5 is a boom control module in accordance with this invention.

A boom control module 54A is mounted on platform 16 as shown in FIGS. 1–2. As seen in FIG. 1, another boom control module 54B is mounted on base 12. Preferably, controller 57 and boom control module 54B are components within the same unit device attached to base 12. Control modules 54A, 54B are operationally connected by cable 72 to boom mechanism 15 by means of controller 57 in a manner familiar to those skilled in the art. Control modules 54A, 54B have boom extension controls 58 and boom position controls 59 allowing an operator on platform 16 or on the ground to extend, elevate or rotate boom 14. Drive controls 60 are also provided where the base 12 is self-propelled. A display of the instrumentation on one preferred embodiment of boom control module 54A is illustrated in FIG. 5.

Figure 6:
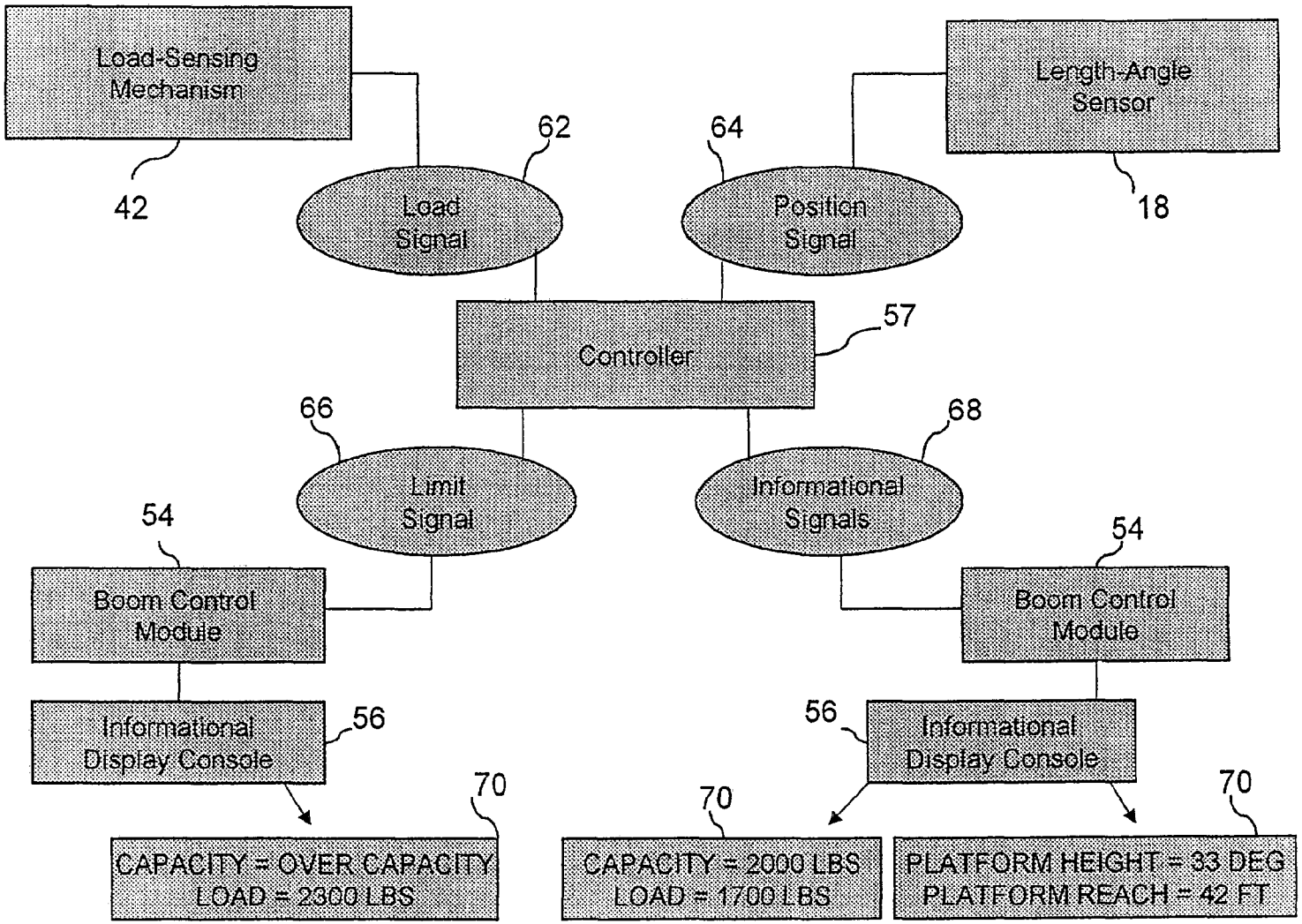
FIG. 6 is a block diagram of certain controller communications in accordance with this invention.

Controller 57 generates control signals in a manner known to those skilled in the art based on the load signal 62 and the position signal 64 received. This operation and associated communications involving controller 57 are illustrated by the block diagram in FIG. 6.

Each control signal generated by controller 57 is received by boom control modules 54A, 54B via serial communication through cable 72. One control signal generated is a limit signal 66. Controller 57 is programmed to generate the limit signal 66 when, given a certain position of the boom 14, the load on platform 16 exceeds a certain value and places aerial work apparatus 10 in a state of overcapacity. Platform capacity is preferably programed to be consistent with all load charts posted on aerial work apparatus 10 and with any applicable industry safety standards.

On receipt of the limit signal 66, boom control modules 54A, 54B are automatically prevented from initiating or continuing any boom movement that would allow the state of overcapacity to continue. Informational display console 56 on boom control modules 54A, 54B in turn generates a message via a visual display panel 70 to inform the operator as to the overcapacity status. Manual control of the boom 14 by the operator is limited at such time to movement either elevating or retracting the boom 14 so that platform 16 is no longer exceeding its programmed capacity.

Other control signals generated by controller 57 are informational signals 68. On receipt of these signals, boom control modules 54A, 54B display on informational display console 56, through a plurality of display panels 70, information as to the height of platform 16 above ground, the longitudinal distance of platform 16 from base 12, the actual load on platform 16, and the recommended capacity of platform 16 with boom 14 at its present position. Display select switch 61 is provided on boom control modules 54A, 54B to allow the operator to select the display panel 70 desired.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. An aerial work apparatus comprising:

a base;

a boom mounted to the base;

a platform attached to the distal end of the boom, the platform having a load;

a boom mechanism operationally attached to the boom for positioning the platform;

a boom control module mounted with respect to the platform for controlling the boom mechanism;

a vertical load-sensing mechanism mounted at the platform for measuring the platform load and generating a load signal based thereon the platform resting upon an uppermost portion of the load-sensing mechanism extending above a vertical holding column attached at the distal end of the boom wherein, the load-sensing mechanism fully supports the platform and the load-sensing mechanism is held in position by and vertically aligned with the holding column; and a controller operationally attached to the boom mechanism and the boom control module, whereby the boom control module controls the boom mechanism through the controller and wherein the controller receives the load signal and at least one position signal relating to the position of the platform and generates at least one control signal based thereon.

2. The aerial work apparatus of claim 1 wherein the load-sensing mechanism includes a load cell.

3. The aerial work apparatus of claim 2 wherein the uppermost portion is a support bushing and the platform includes a platform support member, the platform support member resting upon the support bushing such that the weight of the platform load is directly applied to the support bushing.

4. The aerial work apparatus of claim 3 wherein the load cell is a hydraulic load cell.

5. The aerial work apparatus of claim 1 further comprising at least two sleeve bearings attached to the platform and having a pivotal an engagement with the holding column that is substantially frictionless.

6. The aerial work apparatus of claim 5 wherein the sleeve bearings include sleeve bushings, each of the bushings being configured such that negligible vertical frictional loading occurs between the sleeve bearings and the holding column.

7. The aerial work apparatus of claim 1 wherein:

the control signals generated by the controller include a limit signal based on a determination of overcapacity; and the boom control module receives the limit signal to halt overcapacity movement of the boom, wherein overcapacity movement includes extension of the boom and lowering of the boom.

8. The aerial work apparatus of claim 7 wherein the boom control module includes an informational display console and wherein:

the control signals generated by the controller include informational signals based on a determination of platform load and platform capacity; and the informational display console receives the informational signals and displays the platform load and the platform capacity in response thereto.

9. The aerial work apparatus of claim 8 wherein the informational display console receives the limit signal and displays an overcapacity message in response thereto, thereby alerting the operator that the boom mechanism has been overridden.

10. The aerial work apparatus of claim 9 wherein the informational display console is integral with the boom control module.

11. In an aerial work apparatus having a boom mounted to a base and a platform attached to the distal end of the boom, the platform having a load, the improvement comprising:

a load-sensing mechanism at the platform for measuring the platform load;

a platform support member attached to the platform, the platform support member resting upon the load-sensing mechanism such that the load-sensing mechanism fully supports the platform; and a vertical holding support column attached at the distal end of the boom, the holding column having a top and holding the load-sensing mechanism in position at the top such that the platform support member rest upon an uppermost portion of the load-sensing mechanism extending above the holding column and the load-sensing mechanism is vertically aligned with the holding column.

12. The aerial work apparatus of claim 11 wherein the load-sensing mechanism includes a load cell.

13. The aerial work apparatus of claim 12 wherein the uppermost portion is a support bushing such that the weight of the platform load is directly applied to the support bushing.

14. The aerial work apparatus of claim 13 wherein the load cell is a hydraulic load cell.

15. The aerial work apparatus of claim 11 further comprising at least two sleeve bearings attached to the platform and having a pivotal engagement with the holding column that is substantially frictionless.

16. The aerial work apparatus of claim 15 wherein the sleeve bearings include sleeve bushings, each of the bushings being configured such that negligible vertical frictional loading occurs between the sleeve bearings and the holding column.

* * * * *

UNITED STATES PATENT AND TRADEMARK OFFICE

CERTIFICATE OF CORRECTION

PATENT NO. : 7,004,285 B2
APPLICATION NO. : 10/603967
DATED : February 28, 2006
INVENTOR(S) : Jeffrey H. Bailey It is certified that error appears in the above-identified patent and that said Letters Patent is hereby corrected as shown below:

Column 1, line 38, add --.-- after the word "length".

Column 4, line 2, delete the word "ifirther" and replace with the word --further--.

Column 6, line 7, delete the word "chanter" and replace with the word --chamber--.

Column 7, line 61, delete the word "an" after the word "pivotal".

Signed and Sealed this

Nineteenth Day of September, 2006

JON W. DUDAS
*Director of the United States Patent and Trademark Office*